US011387022B1

(12) United States Patent
Edwards et al.

(10) Patent No.: US 11,387,022 B1
(45) Date of Patent: Jul. 12, 2022

(54) ILLUMINATED POTENTIOMETER

(71) Applicant: Hotpots LLC, Windsor, CO (US)

(72) Inventors: Justin Edwards, Windsor, CO (US); Dana Edwards, Greenley, CO (US)

(73) Assignee: HOTPOTS, LLC, Windsor, CO (US)

( * ) Notice: Subject to any disclaimer, the term of this patent is extended or adjusted under 35 U.S.C. 154(b) by 0 days.

(21) Appl. No.: 16/840,282

(22) Filed: Apr. 3, 2020

Related U.S. Application Data

(60) Provisional application No. 62/828,580, filed on Apr. 3, 2019.

(51) Int. Cl.
*H01C 10/14* (2006.01)
*F21V 33/00* (2006.01)
*H01C 10/16* (2006.01)

(52) U.S. Cl.
CPC ..... *H01C 10/14* (2013.01); *F21V 33/0056* (2013.01); *H01C 10/16* (2013.01)

(58) Field of Classification Search
CPC ..... H01C 10/14; H01C 10/16; F21V 33/0056
See application file for complete search history.

(56) References Cited

U.S. PATENT DOCUMENTS 2,165,199 A * 7/1939 Batcheller ..... H01C 10/32 338/159
3,412,363 A * 11/1968 Hatton ..... H01C 10/32 338/196
5,974,909 A * 11/1999 Bauer ..... B60Q 1/0082 16/430
6,079,401 A * 6/2000 Alvord ..... F24C 3/128 126/39 BA
6,531,952 B1 * 3/2003 Meyer ..... H01H 3/0213 200/314
8,178,805 B2 * 5/2012 Larson ..... H01H 19/025 200/316
8,813,676 B2 * 8/2014 Fuller ..... G05G 1/105 116/310
9,146,033 B2 * 9/2015 Cadima ..... F24C 7/082
9,728,356 B2 * 8/2017 Levay ..... H01H 19/025
2005/0270779 A1 * 12/2005 Mazur ..... G05G 1/105 362/253
2009/0322230 A1 * 12/2009 Wang ..... H01H 13/023 315/136
2011/0211355 A1 * 9/2011 Hakemeyer ..... G04C 23/46 362/382
2014/0311279 A1 * 10/2014 Toth ..... G05G 5/02 74/553

OTHER PUBLICATIONS

EP3291248 (Espacenet; machine translation), Stottinger et al. Published Mar. 7, 2018. (Year: 2018).*

* cited by examiner

*Primary Examiner* — Kyung S Lee
(74) *Attorney, Agent, or Firm* — Avyno Law P.C.

(57) ABSTRACT

The present invention is a modified potentiometer shaft that includes a light source for illuminating the top of the shaft. The shaft further includes electrical connections for providing power to the light source through the potentiometer assembly.

8 Claims, 7 Drawing Sheets

ILLUMINATED POTENTIOMETER

CROSS REFERENCE TO RELATED APPLICATIONS

This application claims priority to U.S. Provisional Patent Application No. 62/828,580, titled Illuminated Potentiometer, filed on Apr. 3, 2019, which application is incorporated into this application in its entirety.

FIELD OF INVENTION

The present invention relates to a potentiometer, in particular, to a potentiometer incorporating a light source and method of making and assembling an illuminated potentiometer.

BACKGROUND

Often informally referred to as a "pot," potentiometers are electro-mechanical transducers and are common devices used for controlling a variety of different elements of an electrical circuit. Particularly, a potentiometer is a three-terminal resistor with a sliding or rotating contact that forms an adjustable voltage divider. If only two terminals are used, one end and the wiper, it acts as a variable resistor or rheostat. Potentiometers commonly consist of a resistive element, a sliding contact (wiper) that moves along the element, making good electrical contact with one part of it, electrical terminals at each end of the element, a mechanism that moves the wiper from one end to the other, and a housing containing the element and wiper.

Potentiometers are rarely used to control significant amounts of power. Instead, they are used to control small amounts of power, most commonly for the control of electrical devices such as volume controls on audio equipment and as control inputs for electronic circuits. Potentiometers may further be used for dimming lights, controlling sound frequencies, and are also widely used as a part of displacement transducers.

Many different types of potentiometers exist in the market for different applications. For example, for audio control, both linear and rotary potentiometers may be used. Additional types of potentiometers used in the industry include slider potentiometers (a potentiometer that is adjusted by sliding the wiper left or right (or up and down, depending on the installation), usually with a finger or thumb), thumbwheel potentiometers (a small rotating potentiometer meant to be adjusted infrequently by means of a small thumbwheel) and trimmer potentiometers (a trimmer potentiometer typically meant to be adjusted once or infrequently for "fine-tuning" an electrical signal).

While many different types of potentiometers, as described above, exist in the market, a need exists for a potentiometer that incorporates a light source that is capable of being illuminated.

SUMMARY

The present invention provides a modified potentiometer shaft that includes a light source in the shaft of the potentiometer that is capable of illuminating the potentiometer. As illustrated in the attached figures, in one example of an implementation of the invention, the illuminated potentiometer includes a modified shaft assembly including a shaft, a cap having at least one light source and a lower casing that encloses a lower shaft platform and lower resistor plate.

In one example of an implementation, the shaft has a bottom end and a top end. The bottom end is molded to the lower shaft platform and the top end has exterior threading. The lower shaft platform includes top and bottom wipers, where the top wiper is connected to a positive lead and the bottom wiper is connected to a negative lead. The lower resistor plate incorporates a conductive band and has one single terminal in which a positive voltage supply is supplied by an external circuit. The conductive band of the lower resistor plate contacts with the top wiper of the lower shaft platform. This contact allows positive voltage to be supplied to the positive lead. A negative voltage supply may be connected anywhere on the lower casing, which acts as a ground. The lower casing contacts the bottom wiper of the lower shaft platform. Both the positive and negative leads, as mentioned above, connect with positive and negative bands located on the exterior threading of the shaft.

The cap includes interior threading for engaging with the exterior threading of the shaft. Similar to the exterior threading of the shaft, the interior threading of the cap also has positive and negative bands. A light source is further molded within the cap and positive and negative leads from the light source are connected to the positive and negative bands on the interior threading of the cap, respectively.

The location of the positive and negative bands on the exterior threading of the shaft matches the location of the positive and negative bands on the interior threading of the cap when the cap is fully twisted on the exterior threading of the shaft. This matching allows the light source to be illuminated when positive voltage is supplied to the lower resistor plate.

The upper casing in combination with the upper shaft platform and upper resistor plate of the present invention acts as a standard potentiometer, which may be used for the control of electrical devices such as volume controls on audio equipment and as control inputs for electronic circuits. For example, in one example of an implementation, a potentiometer having an upper casing that encloses an upper shaft platform and upper resistor plate having three terminals used to control audio or volume inputs may be inserted on top of the shaft so that the bottom of the upper casing rests on the top of the lower resistor plate. Thus, the lower casing in combination with the lower shaft platform (which is molded to a shaft) and lower resistor plate allows for the light source to be illuminated, whereas the upper casing in combination with the upper shaft platform and upper resistor plate acts as a standard potentiometer. Once the upper casing rests on the top of the lower resistor plate, the upper casing may be secured to the lower casing by a middle clip.

In one example of an implementation, an illuminated potentiometer is provided that comprises a shaft having a top end and bottom end, where the bottom end is molded to a lower shaft platform. A cap is provided that includes a light source for engaging and fastening to the top end of the shaft, where both the top end of the shaft and cap include positive and negative leads that align to close a circuit when the cap is fastened to the top end of the shaft. At least one light source is molded within the cap and the positive and negative leads of the cap connect to the light source. A lower casing encloses a lower resistor plate and the lower shaft platform, where the lower resistor plate has one terminal for providing electrical current to the light source. An upper casing is also provided that encloses an upper shaft platform and upper resistor plate, where the upper resistor plate has three terminals for controlling audio or volume inputs.

A method of assembling an illuminated potentiometer is also provide that comprises: (i) providing a molded shaft having a top end and bottom end, where the top end has exterior threading having positive and negative conductive bands and positive and negative shaft leads running from the conductive bands to the bottom end of the shaft; (ii) molding a light source within a cap having positive and negative leads connected to the light source; (iii) securing the cap on the exterior threading of the shaft so that the positive and negative bands on the exterior threading of the shaft match the positive and negative leads on the cap; and (iv) replacing a standard potentiometer shaft with the molded shaft and illuminating the light in the cap by supplying power to the light source in the cap through the positive and negative leads.

In another example of an implementation, an illuminated potentiometer shaft assembly is provided that comprises a lower shaft platform; a shaft having a top and bottom where the bottom is molded to the lower shaft platform; a light source positioned at the top of the shaft; positive and negative leads that run from the light source to the lower shaft platform for powering the light source; a lower resistor plate positioned on top of the lower shaft platform; and a lower casing that encloses the lower resistor plate and the lower shaft platform, where the lower resistor plate has one terminal for providing electrical current to the light source at the top of the shaft.

In yet another example of an implementation, a modified potentiometer shaft is provided comprising a potentiometer shaft; a light source positioned at the top of the potentiometer shaft for illuminating the light source; and electrical connections running from the light source to the bottom of the shaft for providing power to the light source through the potentiometer shaft.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention and be protected by the accompanying claims.

BRIEF DESCRIPTION OF FIGURES

The invention may be better understood by referring to the following figures. The components in the figures are not necessarily to scale, emphasis instead being placed upon illustrating the principles of the invention. In the figures, like reference labels designate corresponding parts throughout the different views.

DETAILED DESCRIPTION

FIGS. 1-9 illustrates one example of an assembly of an illuminated potentiometer of the present invention. As illustrated in FIGS. 1-9, the present invention modifies a standard single-turn potentiometer such that the shaft 102 of the potentiometer includes a removable cap 104 housing a light source 106 for illuminating the top of the shaft 102 through the cap 104. The shaft 102 further includes electrical connections 108 and 110 for providing power to the light source 106 through the potentiometer assembly.

Figure 1:
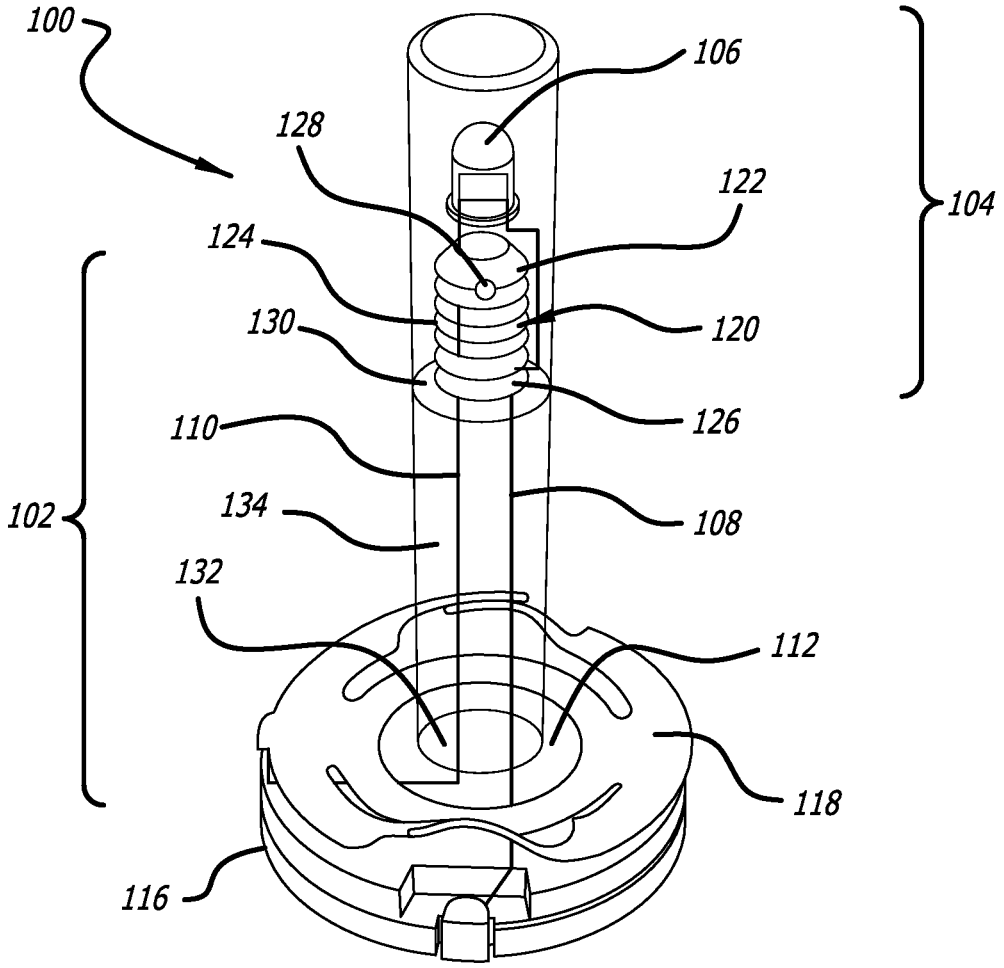
FIG. 1 illustrates a front perspective of one example view of a shaft assembly of the illuminated potentiometer of the present invention.

FIG. 1 illustrates a front perspective of one example view of a shaft assembly 100 of the illuminated potentiometer of the present invention. As noted above, in the illustrated example, the shaft assembly 100 includes the shaft 102 having a removable cap 104. The removable cap 104 covers a light source 106 for illuminating the top of the shaft 102 through the cap 104. The shaft 102 further includes electrical connections 108 and 110 for providing power to the light source 106 through the potentiometer assembly.

The shaft assembly 100 further includes lower shaft platform 112 having a top wiper 114 and bottom wiper 116. Both the shaft 102 and lower shaft platform 112 may be molded together as a single piece. The lower shaft platform 112 has on its top side a double-sided conductive top wiper 118 and on its bottom side a double-sided conductive bottom wiper 116. Both the top wiper 118 and bottom wiper 116 are secured to the lower shaft platform 112. In some examples, the top wiper 118 and bottom wiper 116 may be molded to the lower shaft platform 112.

Similarly, the shaft 102 has a top surface 130 and a bottom surface 132. The bottom surface 132 of the shaft 102 is molded to the top side of the lower shaft platform 112. At the top end of the shaft 102 is a screw set 120 that has exterior threading 124 for engaging interior threading (not shown) on the cap 104 so that the cap 104 can twist on and lock into place using a small screw that is inserted into set screw opening 128 on the exterior threading of the set screw 120 and cap 104. Aligning set screw openings 128 are found on the exterior threading of the screw set 120 and the cap 104, and will always align evenly when the cap 104 is fully twisted on the exterior threading of the set screw 120.

The light source (e.g., LED) 106 is molded inside the cap 104 as a single piece. The cap 104 is molded separately from the shaft 102 and shaft platform 112. This allows for the interchanging of different caps 104, as desired. For example, different shapes, sizes, and colors of caps 104 may be interchanged for providing different illuminating effects such as different colored light sources 106. Both the cap 104 and shaft 102 may be molded in clear acrylic. While the cap 104 may be molded from a transparent mold such as clear acrylic, thus allowing light to pass through, the cap 104 may also be molded with different materials having different transparencies for changing the amount of light that passes through; thus, changing the brightness of the light.

While a standard LED light source 106 is shown in FIG. 1, any type of light source 106 can be used, including but not limited to, super bright LED's, fluorescent, compact fluorescent, halogen, or incandescent. Furthermore, the light source 106 can be a single LED, as shown in FIG. 1, or a plurality of LEDs. The light source(s) 106 may also be made to flicker or light alternatively to create a flickering or color changing effect by any circuitry known in the art that creates a flickering or color changing effect.

To power the light source, both the exterior threading of the screw set 120 and interior threading of the cap 104 are molded with a set of conductive bands (positive and negative) 110 and 108, respectively. The positive and negative bands 110, 108 on both the exterior threading of the screw set 120 (extending to the base on the exterior of the shaft 102) and interior threading of the cap 104 are spaced apart to avoid contact. As illustrated in FIG. 1, while the positive band 122 is shown to be located at the top of the screw set 120 and the negative band 1126 is located on the bottom of the set screw 120 of the shaft 102, in other examples of implementations, the negative band 126 may be located at the top of the set screw 120 of the shaft 102 and the positive band 122 may be located on the bottom of the set screw 120 of the shaft 102. The location of the positive and negative bands 110, 108 on the exterior threading 124 of the screw set 120 on the shaft 102 must match the location of the positive and negative bands 110, 108 on the interior threading of the cap 104 when the cap 104 is fully twisted on the exterior threading 124 of the screw set 120 on the shaft 102 to connect the circuit.

Figure 2:
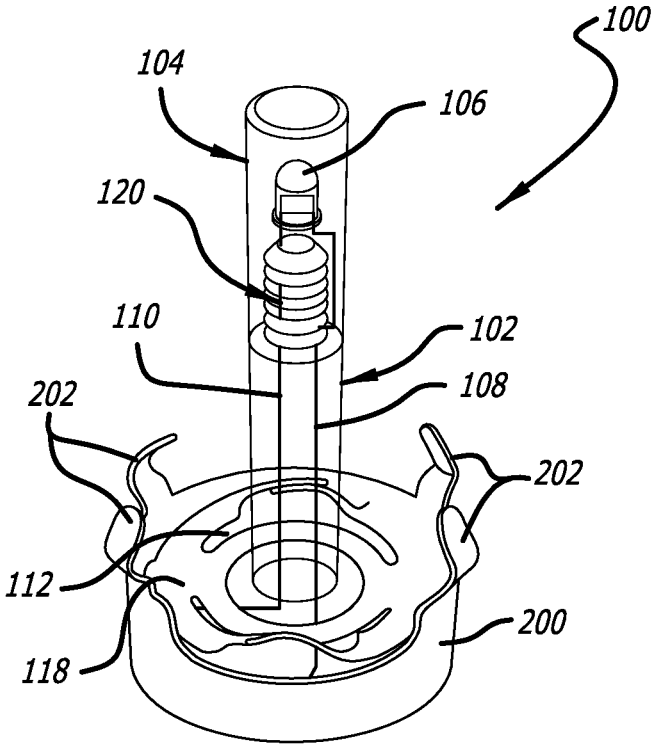
FIG. 2 illustrates a front perspective view of the shaft assembly of FIG. 1 positioned within a lower casing.
Figure 3:
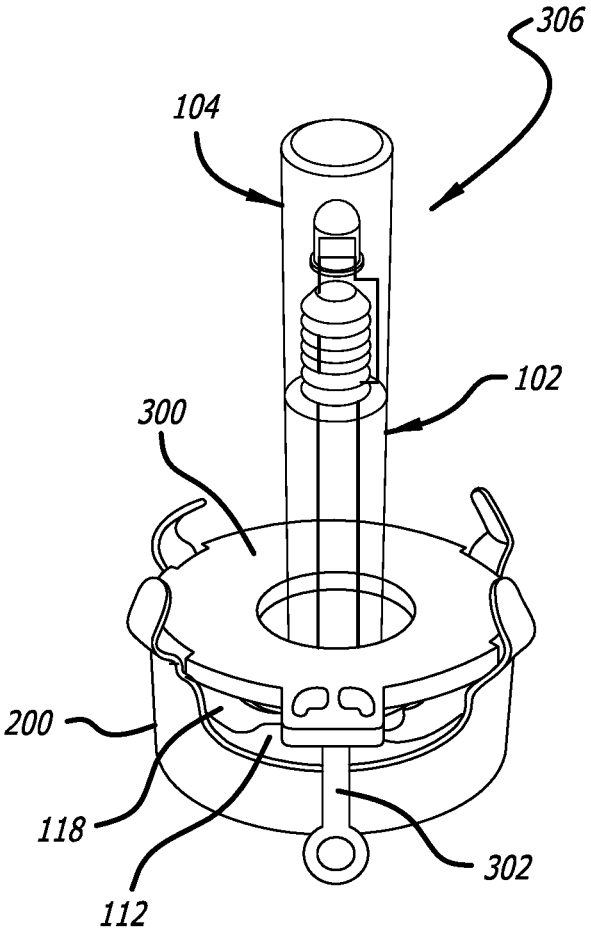
FIG. 3 illustrates a front perspective view of the shaft assembly of FIG. 2 having a lower resistor plate positioned within the lower casing.

Positive and negative leads 110, 108 are soldered to the positive and negative bands 122, 126 of the exterior threading 124 of the screw set 120 of the shaft 102, respectively. These positive and negative leads 110, 108 are run from the exterior threading 124 of the screw set 120 of the shaft 102 through the body 134 of the shaft 102, and to the lower shaft platform 112. The positive lead 110 is soldered to the top wiper 118 of the lower shaft platform 112 and the negative lead 108 is soldered to the bottom wiper 116 of the lower shaft platform 112. The top wiper 112 will make contact with the underside of the lower resistor plate 300 (as shown in FIG. 3) and the bottom wiper 116 will make contact with the lower casing 200 (as shown in FIG. 2), which acts as a ground. Both the positive and negative leads 110, 108 may be insulated to avoid making contact with one another in the narrow part of the shaft as both the positive and negative leads 110, 108 will be close to each other.

Positive and negative leads 110, 108 are also soldered to the positive and negative bands of the interior threading of the cap 104, respectively. These positive and negative leads 110, 108 are run from the interior threading of the cap 104 to the light source 106, which is molded inside the cap 104. The positive lead 110 is soldered to the positive plate within the LED light source 106 and the negative lead 108 is soldered to the negative plate within the LED light source 106.

Figure 10A:
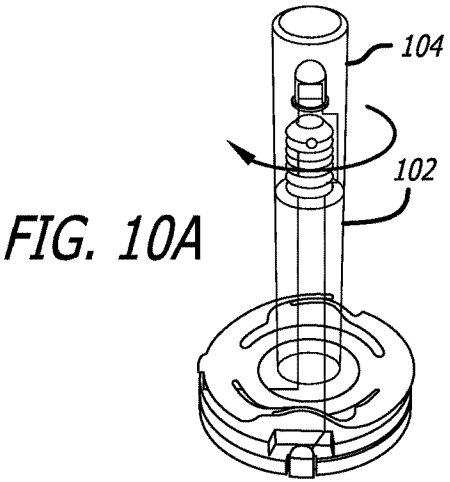
FIGS. 10*a*-10*i* illustrate the assembly steps of the illuminated potentiometer of the present invention to create the finished assembly.
Figure 10B:
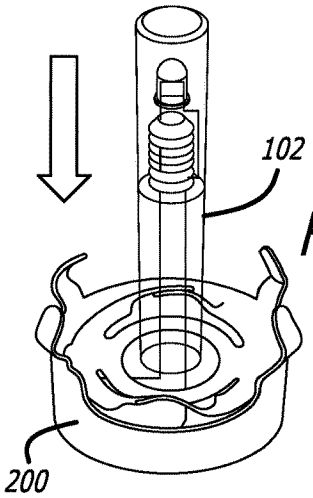
Figure 10C:
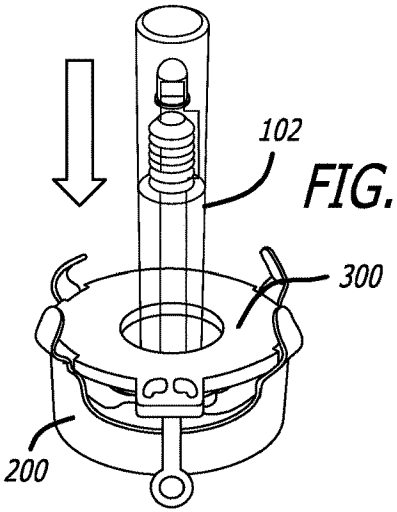
Figure 10D:
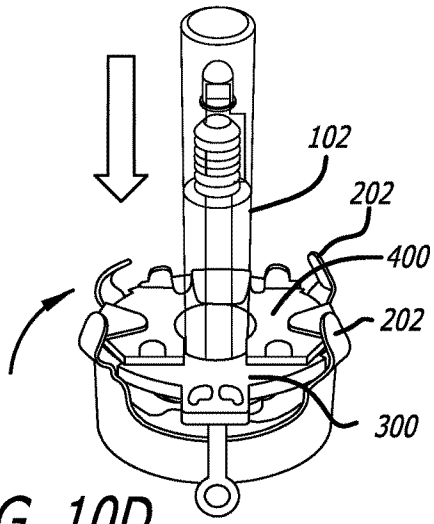
Figure 10E:
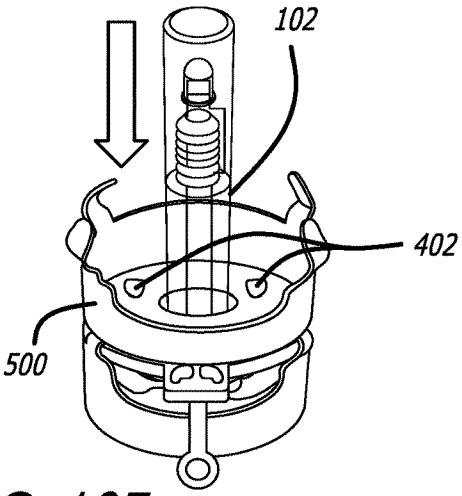
Figure 10F:
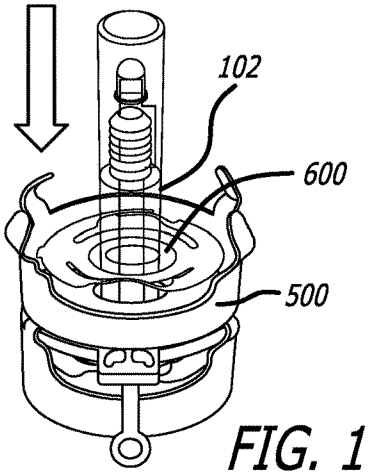
Figure 10I:
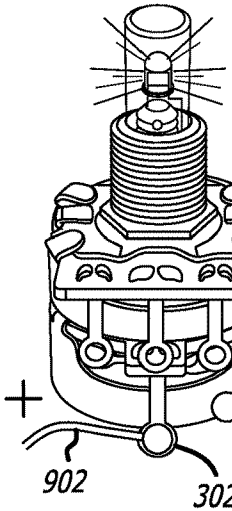
Figure 10H:
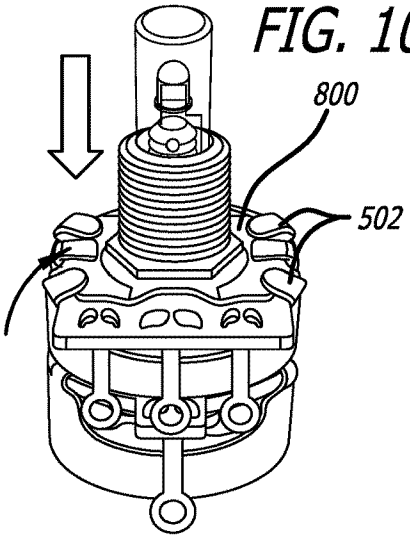
Figure 10G:
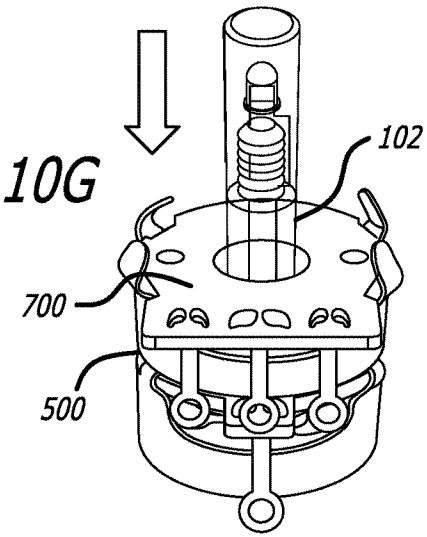
Figure 10K:
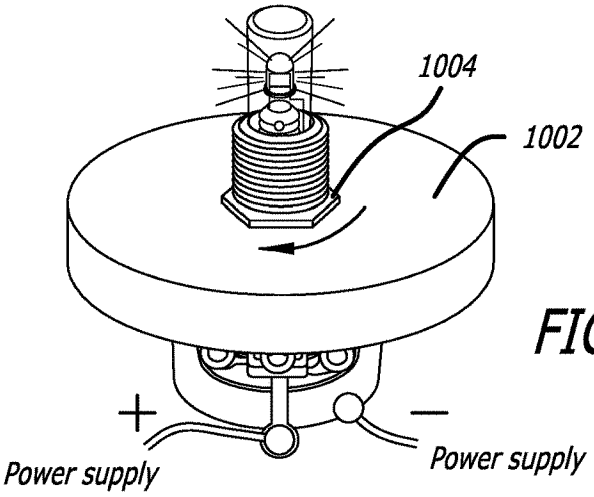
FIGS. 10*j* & 10*k* show how the illuminated potentiometer finished assembly is fit into and secured to into a corresponding hole on an instrument body.

In operation, the matching of positive and negative bands between the exterior threading 124 of the screw set 120 of the shaft 102 and interior threading of the LED cap 104 close the circuit and cause electrical current to flow such that the LED light source 106 may be illuminated when connected to a power supply (see FIG. 10*k*).

Further, a molded ring (not shown) may also be located on the exterior bottom of the lower shaft platform 112 to allow the shaft 102 and lower shaft platform 112 to rest or spin freely on the lower casing 200 (as shown in FIG. 2).

FIG. 2 illustrates a front perspective view of the shaft assembly 100 of FIG. 1 positioned within a lower casing 200. The lower casing 200 does not use a stop and is completely flat on the bottom. The interior bottom of the casing may be greased to help the molded ring on the bottom of the lower shaft platform 112 spin freely. The lower casing 200 also includes four tabs 202 for fastening to a middle clip 400, as shown in FIG. 4.

Figure 7:
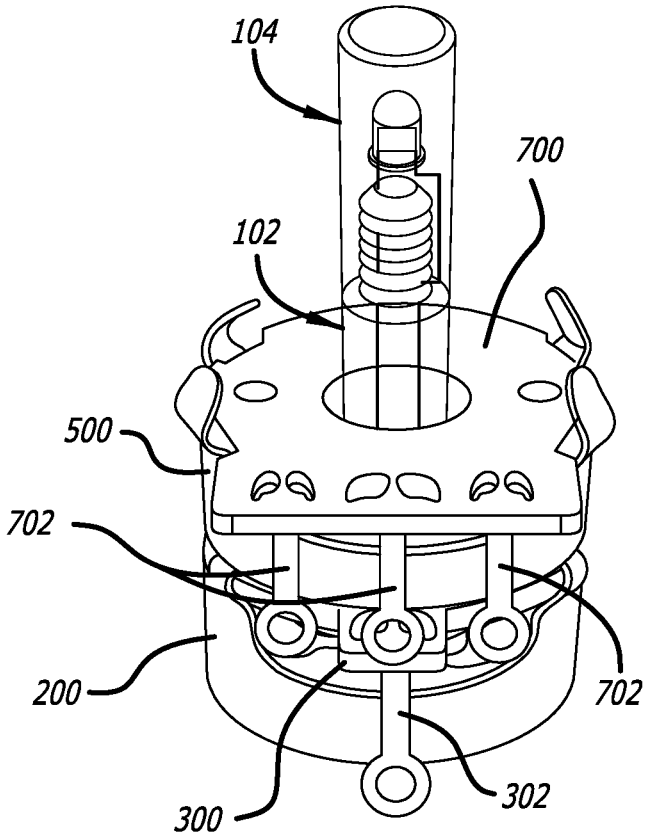
FIG. 7 illustrates a front perspective view of an upper resistor plate positioned on the upper casing and upper shaft platform of FIG. 6.
Figure 9:
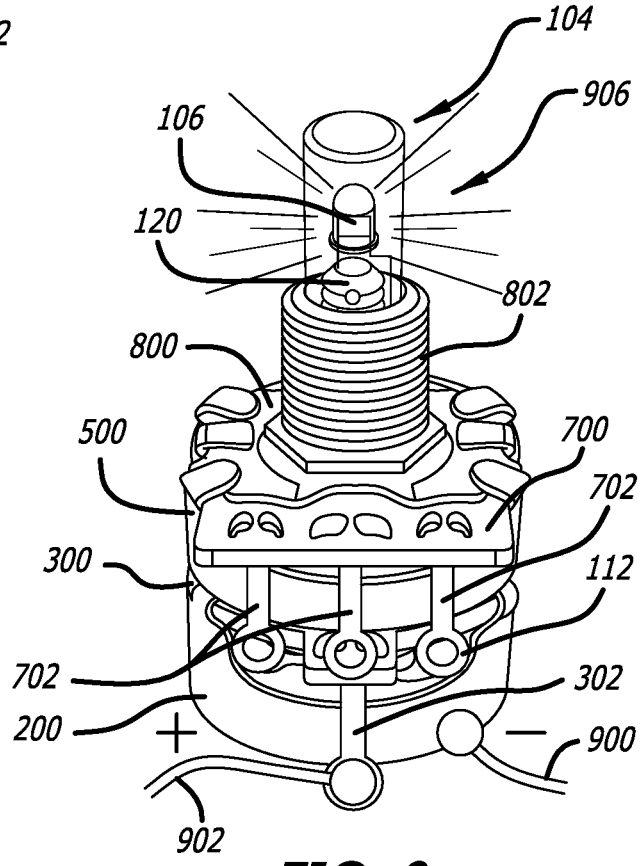
FIG. 9 illustrates a front perspective view of a finished assembly with wiring of one implementation of the illuminated potentiometer of the present invention.

FIG. 3 illustrates a front perspective view of the shaft assembly 100 of FIG. 2 having a lower resistor plate 300 positioned within the lower casing 200. The lower resistor plate 300 may use a similar shaped plate as the upper resistor plate 700 (as shown in FIG. 7). However, unlike the upper resistor plate 700 that acts as a standard potentiometer for controlling audio or volume inputs, the lower resistor plate 300 does not actually resist any movement of any wiper incorporated in the present invention. Rather, the lower resistor plate 300 incorporates a flat copper conductive band (not shown) that is molded directly into the plastic on the underside of the lower resistor plate 300, which makes contact with the top wiper (in which a positive lead is soldered) of the lower shaft platform 112. Thus, the lower resistor plate's 300 primary purpose is to allow electrical current to pass through regardless of its position when the shaft 102 is turned to illuminate the LED light source 106. Furthermore, unlike the standard three terminals found on standard resistor plates of potentiometers, the lower resistor plate 300 incorporates only one single terminal 302. This single terminal 302 is soldered to the flat copper conductive band on the underside of the lower resistor plate 300. As shown in FIG. 9, the lower resistor plate 300 acts as the positive supply voltage for the LED light source 106. No negative or ground connection is made to the lower resistor plate 300 itself.

FIG. 3 also illustrates one example of an implementation of a potentiometer shaft illumination device 306 that may optionally be used in connection with any standard potentiometer found on the market for illuminating the potentiometer. In this manner, standard potentiometers can be retrofitted with the potentiometer shaft illumination device 306 to cause the standard potentiometers to illuminate.

Figure 4:
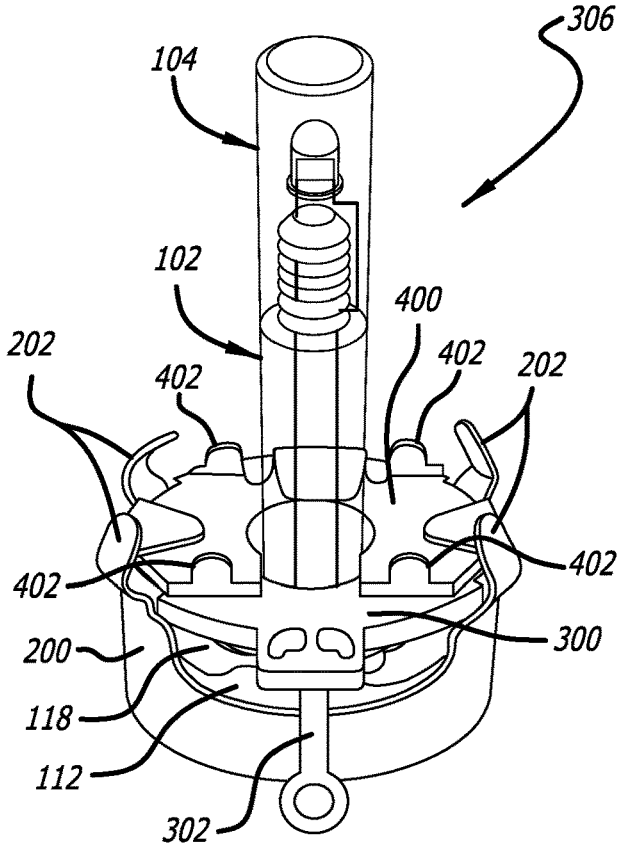
FIG. 4 illustrates a front perspective view the potentiometer shaft illumination device of FIG. 3 having a middle clip.
Figure 5:
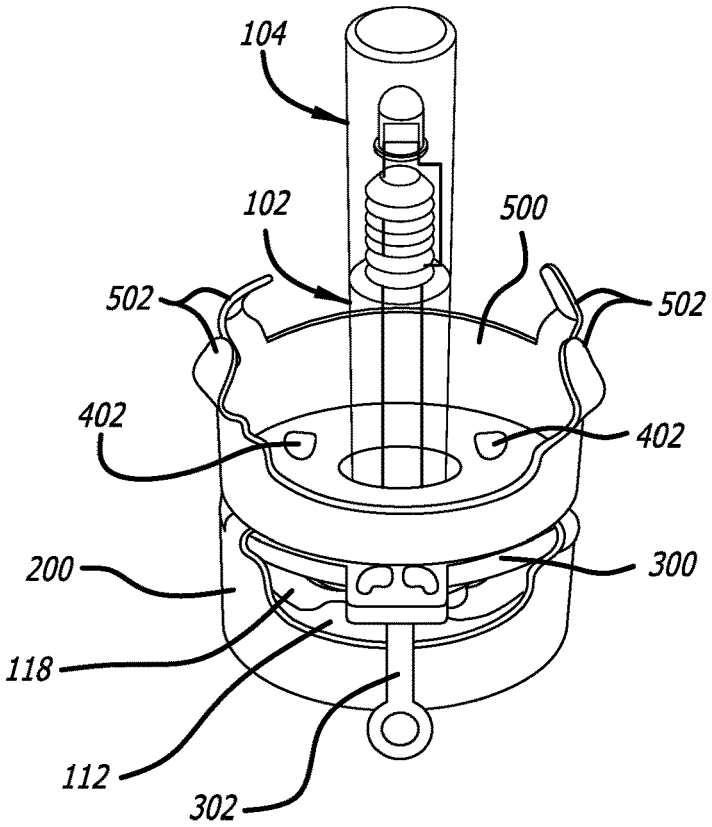
FIG. 5 illustrates a front perspective view of an upper casing mounted on the potentiometer shaft illumination device of FIG. 4.

FIG. 4 illustrates a front perspective view the potentiometer shaft illumination device 306 of FIG. 3 having a middle clip 400. The middle clip 400 may be used to secure or connect the lower casing 200 to the upper casing 500 (as seen in FIG. 5) of the of the illuminated potentiometer assembly. As mentioned above, the middle clip 400 is fastened to the lower casing 200 by folding over the four tabs 202 of the lower casing 200 so that both the lower resistor plate 300 and the middle clip 400 are contained. The middle clip 400 may be centered to avoid causing friction when the shaft 102 is turned. Before inserting the upper casing 500 to the potentiometer assembly, the four vertical tabs 402 on the middle clip 400 will need to be straightened to a 90 degree angle. The potentiometer shaft illumination device 306 may also be provided with the middle clip 400 for retrofitting a standard potentiometer.

Figure 6:
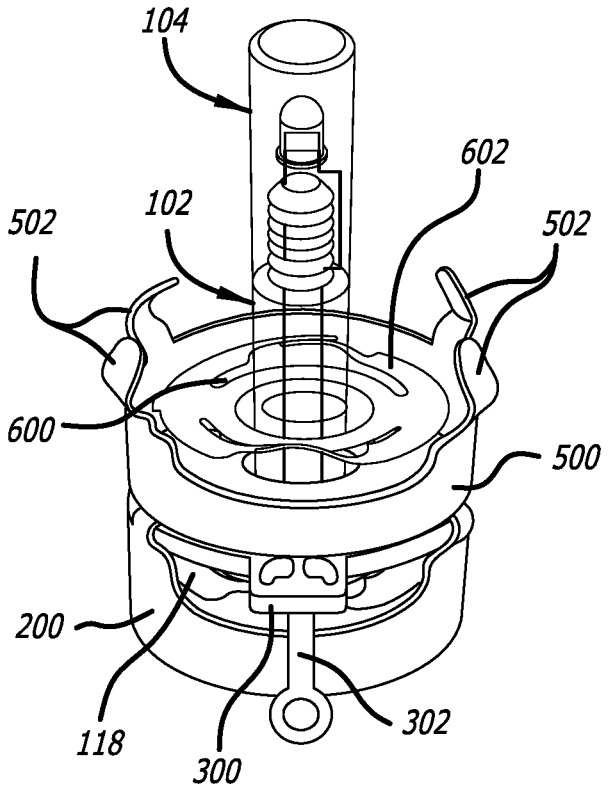
FIG. 6 illustrates a front perspective view of the upper shaft platform mounted on the upper casing on the potentiometer shaft illumination device of FIG. 4.

FIG. 5 illustrates a front perspective view of an upper casing 500 mounted on the potentiometer shaft illumination device 306 of FIG. 4. As stated above, the upper casing 500 is secured to the potentiometer shaft illumination device 306 by folding over the four vertical tabs 402 on the middle clip 400 once the upper casing 500 is in place. These tabs 402 may be tightly compressed to prevent obstruction of the upper shaft platform 600 (as shown in FIG. 6) when the shaft 102 is turned. Grease may also be applied to the interior bottom of the upper casing 500 prior to assembling the upper shaft platform 600 to aid with the smooth turning of the shaft 102. To prevent the shaft 102 from turning a full 360 degrees, the upper casing 500 may also use a stop, which is located in the lower front of the upper casing. The upper casing 500 also includes four tabs 502 for fastening or securing both the upper resistor plate 700 and top plate 800, as shown in FIGS. 7-9.

FIG. 6 illustrates a front perspective view of the upper shaft platform 600 mounted on the upper casing 500 on the potentiometer shaft illumination device 306 of FIG. 4. After the upper casing 500 has been assembled on the potentiometer shaft illumination device 306, the upper shaft platform 600 is then slid down the shaft 102 until the bottom of the upper shaft platform 600 rests on the top of the interior of the upper casing 500. The upper shaft platform 600 incorporates only one double wiper 602 located on the top of the upper shaft platform 600. This double wiper 602 will make contact with the resistor or audio taper located on the underside of the upper resistor plate 700 (see FIG. 7). The front of the upper shaft platform 600 is aligned with a stop in the lower front of the upper casing 500. The upper shaft platform 600 is then glued in place.

FIG. 7 illustrates a front perspective view of an upper resistor plate 700 positioned on the upper casing 500 and upper shaft platform 600 of FIG. 6. The upper resistor plate 700 functions as a standard potentiometer known in the art. The upper resistor plate 700 consists of three terminals 702. As stated above, the underside of the upper resistor plate 700 makes contact with the wiper 602 located on the top of the upper shaft platform 600. Different model audio taper potentiometers may be used in accordance with the present invention, including but not limited to 500k potentiometers, 250k potentiometers, 50k potentiometers or 25k potentiometers. The primary difference between these different potentiometer is the resistance levels. For example, when used in a musical instrument such as a guitar, a higher value potentiometer (e.g. 500k) will generally create a brighter tone with the guitar.

Figure 8:
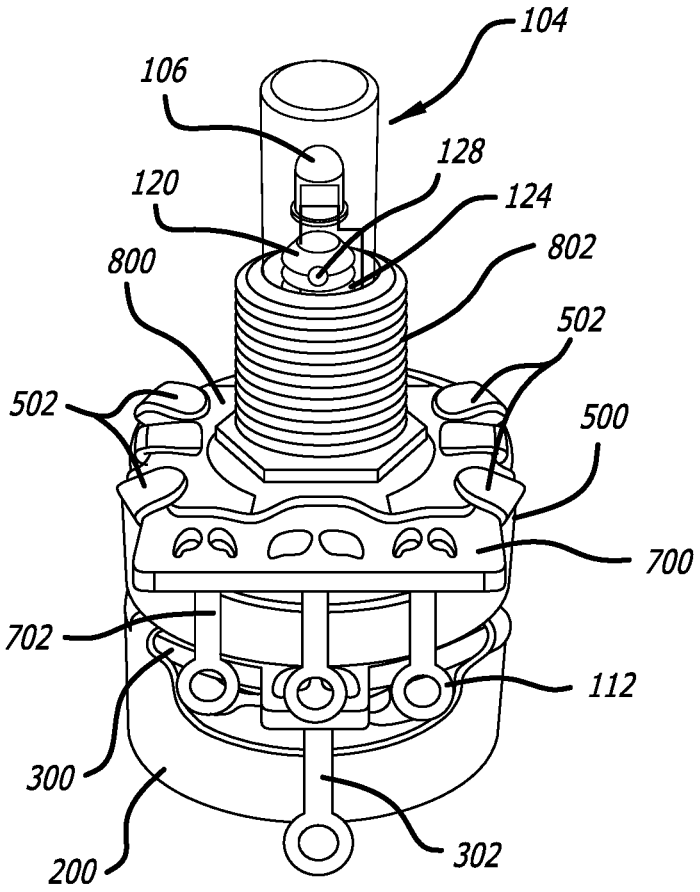
FIG. 8 illustrates a front perspective view of a top plate positioned over the upper resistor plate of FIG. 7.

FIG. 8 illustrates a front perspective view of a top plate 800 positioned over the upper resistor plate 700 of FIG. 7. After the upper resistor plate 700 is slid down the shaft 102, the top plate 800, having a top plate barrel 802, is then assembled by sliding down the shaft 102 and resting on top of the upper resistor plate 700. The top plate 800 is secured by folding over the four tabs 502 from the upper casing 500. These four tabs 502 not only secure the top plate 800, but also the upper resistor plate 700. The total height of the top plate 800 should be no more than even with the bottom of the set screw opening 182 in the exterior threading 124 of the shaft 102. The shaft 102 and plate barrel 802 opening are sized such that there is minimal play between the interior surface of the top plate barrel 802 and the shaft 102 when the shaft 102 is turned.

FIG. 9 illustrates a front perspective view of a finished assembly with wiring of one implementation of the illuminated potentiometer of the present invention. Once assembled, the light source 106 needs to be connected to a power source to illuminate. The light source 106 may be illuminated by connecting, for example, a 9v positive supply charge 902 to the single terminal 302 located on the lower resistor plate 300 and connecting a 9v negative supply charge 900 anywhere on the lower casing 200, which is the ground. Depending on the light source used, other voltages may also be supplied to illuminate the light source 106, including but not limited to any voltage within a 1v-9v range. The power that is supplied may come from an external circuit. As long as the power supply is live, the light source 106 will always be illuminated. Additional resistance may also be added to the external circuit depending on the voltage of the light source used and the voltage of the power supply.

Once the wiring is complete, the light source or LED cap 104 may then be interchanged with different caps 104 by simply unscrewing the set screws in the cap 104 and untwisting the cap 104. As shown in the finished assembly of one example of an illuminated potentiometer in FIG. 9, the lower casing 200 in combination with the lower shaft platform 112 and lower resistor plate 300 allows for the LED source 106 to be illuminated, whereas the upper casing 500 in combination with the upper shaft platform 600 and upper resistor plate 700 acts as a standard potentiometer, the three terminals 702 of which may then be wired to control volume or audio inputs.

Figure 10J:
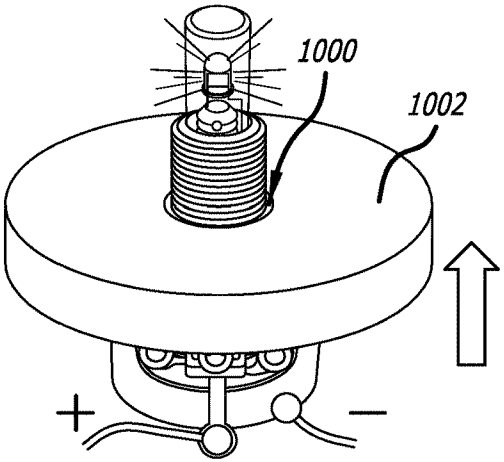

FIGS. 10*a*-10*k* illustrate the assembly steps of the illuminated potentiometer of the present invention to create the finished assembly 906. FIGS. 10*j* & 10*k* show how the illuminated potentiometer is fit into and secured to into a corresponding hole on an instrument body. For purposes of illustration, the illuminated potentiometer may be referred to by its trademark HOT POT™. Those skilled in the art will also appreciate that the steps set forth and described below, and in connection with FIGS. 10*a*-10*k* do not necessarily need to be performed in the order described.

FIG. 10*a* illustrates the placement of the LED cap 102 on the shaft 104 by twisting the LED cap 102 until tight onto the shaft 102. FIG. 10*b* shows the insertion of the shaft 102 into the lower casing 200. FIG. 10*c* illustrates the sliding the lower resistor plate 300 over the shaft 102 until it rests flat on the lower casing 200. FIG. 10*d* illustrates the sliding of the middle clip 400 over the shaft 102 until it sits flat on the lower resister plate 300. Tabs 202 are then folded in on the lower casing 200 to secure the middle clip 400 against the lower resister plate 300.

FIG. 10*e* illustrates the sliding of the upper casing 500 over the shaft 102 until it sits flat on the middle clip 400. The tabs 402 on the middle clip 400 are then folded down to secure the upper casing 500 on the middle clip 400. FIG. 10*f* illustrates the sliding of the upper platform 600 over the shaft 102 until the platform 600 rests lightly on the bottom of the upper casing 500. FIG. 10*g* illustrates the sliding of the upper resistor plate 700 over the shaft 700 until it sits flat on upper casing 500. FIG. 10*h* illustrates the sliding of top plate 800 over the shaft 102 until the top plate 800 rests flat on the upper resistor plate 700. The tabs 502 on the upper casing 500 are then folded inward to secure the top plate 800 to the upper resistor plate 700. FIG. 10*i* illustrates how the positive lead 902 is then soldered to the lower resister plate terminal 302 and how the negative lead 900 is soldered to the lower casing 200. FIG. 10*i* also illustrates the illumination of the light source 106 when the leads 902,900 are connected to a power source.

FIG. 10*j* shows the finished assembly being slid through an opening 1000 in an apparatus 1002 (e.g., instrument body). FIG. 10*k* illustrates how the finished assembly is secured to the apparatus 1002 by sliding a washer and nut assembly 1004 over the plate barrel 802 of the top plate 800 (FIG. 8). The nut is then tightening to secure the finished assembly to the apparatus 1002.

Those skilled in the art will recognize that a similarly constructed shaft can be used to illuminate potentiometers of different construction without departing from the scope of the inventions. Further, it will be recognized that while the cap of the present invention is taught be removable and interchangeable, the shaft could be designed to be one piece with the cap, having the LED molded near the top of the shaft with lead lines running from the LED through the shaft. Further, when using a removable and interchangeable cap, it is not necessary that the cap engaged with the shaft as taught above. Friction fits, magnet connections and other known mechanisms for connecting parts may be used to secure the cap to the shaft. Other types of electrical connections beside those taught above can be used between the light source in the cap and electrical connections in the shaft, including, for example, through the use of the pogo pins.

Those skilled in the art will further recognize that once installed the illuminated potentiometer of the present invention may illuminate the body of an instrument or device, such as a guitar or amplifier. Further, caps 104 can be interchanged; caps 104 can be made of different colors, materials, shapes and sizes. Cap covers can further be made to be interchanged For example, a star-shaped cap cover can be used to cover the cap 104. In this manner, different shapes, sizes, or colors of cap covers may be used to cover the caps of the present invention to change the appearance of the illuminated potentiometer without removing the caps 104.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An illuminated potentiometer comprising:

a shaft having a top end and bottom end, where the bottom end is molded to a lower shaft platform;

a cap that includes a light source for engaging and fastening to the top end of the shaft, and where both the top end of the shaft and cap include positive and negative leads that align to close a circuit when the cap is fastened to the top end of the shaft;

at least one light source molded within the cap, where the positive and negative leads of the cap connect to the light source;

a lower casing that encloses a lower resistor plate and the lower shaft platform, where the lower resistor plate has one terminal for providing electrical current to the light source; and an upper casing that encloses an upper shaft platform and upper resistor plate, where the upper resistor plate has three terminals for controlling audio or volume inputs.

2. A method of assembling an illuminated potentiometer, the method comprising:

providing a molded shaft having a top end and bottom end, where the top end has exterior threading having positive and negative conductive bands and positive and negative shaft leads running from the conductive bands to the bottom end of the shaft;

molding a light source within a cap having positive and negative leads connected to the light source;

securing the cap on the exterior threading of the shaft so that the positive and negative bands on the exterior threading of the shaft match the positive and negative leads on the cap;

replacing a standard potentiometer shaft with the molded shaft and illuminating the light in the cap by supplying power to the light source in the cap through the positive and negative leads.

3. An illuminated potentiometer shaft assembly comprising:

a lower shaft platform;

a potentiometer shaft having a top and bottom, where the bottom is molded to the lower shaft platform;

a light source positioned at the top of the potentiometer shaft;

positive and negative leads that run from the light source to the lower shaft platform for powering the light source;

a lower resistor plate positioned on top of the lower shaft platform; and a lower casing that encloses the lower resistor plate and the lower shaft platform, where the lower resistor plate has one terminal for providing electrical current to the light source at the top of the potentiometer shaft.

4. The illuminated potentiometer shaft assembly of claim 3 further comprising an upper casing that encloses an upper shaft platform and upper resistor plate, where the upper resistor plate has three terminals for controlling audio or volume inputs.

5. A modified potentiometer shaft assembly comprising:

a potentiometer shaft having a top and bottom;

a light source positioned at the top of the potentiometer shaft for illuminating the light source; and electrical connections running from the light source to the bottom of the potentiometer shaft for providing power to the light source through the potentiometer shaft;

a lower resistor plate enclosed by a lower casing where the lower resistor plate has a terminal for providing electrical current to the light source at the top of the potentiometer shaft through at least one electronic connection; and a upper resistor plate where the upper resistor plate has at least one terminal for controlling audio or volume inputs.

6. The modified potentiometer shaft assembly of claim 5, where the lower resistor plate has at least three terminals for controlling audio or volume inputs and is positioned on the bottom of the potentiometer shaft.

7. The modified potentiometer shaft assembly of claim 5, where the potentiometer shaft includes a removable cap covering the light source.

8. The modified potentiometer shaft assembly of claim 5, where the upper resistor plate has at least three terminals for controlling audio or volume inputs.

* * * * *